US008328469B1

(12) United States Patent
Bonin

(10) Patent No.: US 8,328,469 B1
(45) Date of Patent: Dec. 11, 2012

(54) METHOD AND APPARATUS FOR RAINWATER REMEDIATION ON OUTDOOR PLAYING FIELD SURFACES

(76) Inventor: Gregory L. Bonin, Lafayette, LA (US)

( * ) Notice: Subject to any disclaimer, the term of this patent is extended or adjusted under 35 U.S.C. 154(b) by 428 days.

(21) Appl. No.: 12/253,761

(22) Filed: Oct. 17, 2008

(51) Int. Cl.
*E01H 1/00* (2006.01)

(52) U.S. Cl. ..... 405/263; 405/302.6

(58) Field of Classification Search ..... 405/52, 405/263, 302.6
See application file for complete search history.

(56) References Cited

U.S. PATENT DOCUMENTS

| | | | | |
|---|---|---|---|---|
| 2,687,358 | A * | 8/1954 | Allberry et al. | 106/287.26 |
| 2,807,910 | A * | 10/1957 | Erickson | 47/58.1 R |
| 3,286,475 | A * | 11/1966 | Adams | 405/264 |
| 4,401,475 | A * | 8/1983 | Eriksson et al. | 134/6 |
| 4,650,368 | A * | 3/1987 | Bayer | 405/111 |
| 5,770,086 | A | 6/1998 | Indriksons | |
| 6,049,943 | A * | 4/2000 | Carter | 15/340.3 |
| 6,358,312 | B1 | 3/2002 | Tanner et al. | |
| 6,523,681 | B1 | 2/2003 | Hacikyan | |
| 6,524,670 | B1 * | 2/2003 | Kataoka | 428/35.2 |
| 6,586,083 | B1 | 7/2003 | Weiss, Jr. et al. | |
| 6,810,831 | B1 | 11/2004 | Opfel | |
| 2006/0140725 | A1 * | 6/2006 | Benjamin et al. | 405/128.7 |
| 2006/0179596 | A1 * | 8/2006 | Sharratt | 15/230.11 |

OTHER PUBLICATIONS

Reiner, Jim. The Ultimate Baseball Field Renovation Guide.com. Website, Aug. 29, 2008.

* cited by examiner

*Primary Examiner* — Tara Mayo-Pinnock

(57) ABSTRACT

A method of remediation of an athletic field playing surface after a rainfall is disclosed. The method includes the steps of providing a quantity of water absorbing polyacrylate polymer such as potassium polyacrylate, spreading the water absorbing polyacrylate polymer over an area of athletic field playing surface where rainwater has fallen or collected, allowing time for the water absorbing polyacrylate polymer to absorb the rainwater and produce a gel from the combination of the rainwater with the water absorbing polyacrylate polymer, then removing the gel so produced from the athletic field playing surface. The gel or remnants of the gel so produced may also be raked into the dirt of the athletic field.

13 Claims, 2 Drawing Sheets

METHOD AND APPARATUS FOR RAINWATER REMEDIATION ON OUTDOOR PLAYING FIELD SURFACES

FIELD OF INVENTION

This invention relates to sports playing field surfaces and more particular relates to methods for control of accumulated water on sports field playing surfaces.

BACKGROUND OF INVENTION

Rainwater accumulating on outdoor sports field playing surfaces presents many problems. Among them are the risk of injury to the athlete, long term and short term damage to playing surfaces, and delay or postponement of scheduled sporting events. Accumulated rainwater on outdoor sports field playing surfaces increases the cost associated with the maintenance and use of outdoor athletic fields and the risk expense associated with scheduling sporting events at outdoor venues at all levels of sport including the grade school, high school, college, and professional level.

Baseball fields and parks are particularly susceptible to unpredictable weather especially rainfall. The principal methods employed for control of accumulated rainfall on baseball fields includes covering the field surfaces with rain tarps. Such tarps must be used either prior to or at the early stages of rainfall to prevent excess collection of rainwater. Other techniques include applying sand or other dry soil materials to playing field surfaces where rainwater has collected or applying clay or soil clay mixtures to absorb and control the rainwater accumulation.

The use of tarps to cover field surfaces presents many problems due to the time involved in properly applying a tarp or tarps over the playing surface, the requirement of anticipating the time and duration of a rainfall, the potential for injury to workers when the tarps are applied and then removed. Similarly, applying dry soil or adsorbent clay materials in an effort to dry or absorb rainwater on playing surfaces presents additional problems. The addition of soil or clay materials is only partially effective in controlling the rainwater and the use of such additional soil or clay can materially alter the playing surface. Such playing surface alternations can hinder the way in which a game is played, pose risks to the athletes because of altered or uneven playing surfaces, and can result in costly remediation expenses after a game is completed. Consequently, a need exist for improvements in handling accumulated rainwater on outdoor playing field surfaces.

SUMMARY OF INVENTION

Water absorbing polyacrylates are used as a vehicle for water collection on athletic field surfaces. The use of such polyacrylates to control and remediate the accumulation of water on playing surfaces will minimize or eliminate the problems associated with conventional water control methods. In particular, the use of acrylamide/potassium acrylate copolymer, cross-linked, a whitish granular odorless polymer that will yield a gel-like material with the addition of water, applied to standing rainwater on an athletic field surface will result in the absorption of such rainwater at the rate of more than 250 times by weight of the applied polymer material. A few minutes after applying the acrylamide/potassium acrylate copolymer over standing or accumulated rainwater on the field surface will result in the formation of a gel-like material with the rainwater that can be scooped up and collected for disposal. Any remaining amounts of the gel produced by the combination of the polymer and rainwater may be simply raked into the field surfaces with minimal effect on the playing area.

It is thought that acrylamide/potassium acrylate copolymer, cross-linked, will be the preferred water absorbent polymer because its composition would not materially affect or damage turf grasses. Consequently, it could be used on both grass and dirt surfaces to produce the gel-like end product with accumulated rainwater. In fact, its potassium base may produce some beneficial effect on turf grasses. However, sodium polyacrylate will have water absorbing properties similar to those of potassium polyacrylate and will produce a gel-like material when combined with rainwater similar to that produced by potassium polyacrylate. While the use of sodium based polymers such as sodium polyacrylate may have some long term deleterious effect on the turf grasses and field runoff due to its sodium (salt) based nature, sodium polyacrylate could be utilized with some efficacy on the grass free dirt surfaces of playing fields, particularly baseball fields, with the same water absorbing results and capabilities as the use of potassium polyacrylate. Such dirt surfaces on baseball fields where both sodium polyacrylate and potassium polyacrylate might be utilized to control accumulated rainwater include the infield surfaces, the pitcher's mound, the base paths, and the home plate area including the batters boxes.

Because of the ability of the polyacrylates described herein to absorb hundreds of times their weight in water, only a relative a minimal amount of the polymer material, such as potassium acrylate or sodium acrylate, is necessary to achieve the same water absorbing capacity as the clay based products presently being used for turf applications. Typically such clay based products are packed in fifty pound bags. Such bags are heavy, bulky, and inconvenient to store and transport. It may take many such fifty pound bags of clay based products to prepare a playing surface, such as baseball field, for play after a heavy rain downpour if the plying surface can be prepared for play at all by the use of such clay products. Further, the use of such clay base products is labor intensive and time consuming.

As described herein, the use of water absorbing polyacrylate as a field remediation vehicle will reduce the time required to prepare a playing surface after a heavy rainfall. The use of water absorbing polyacrylate will require significantly less material by both weight and volume than clay based products and the polyacrylate may be easy applied and picked up by only one or two groundskeepers resulting in substantially less cost to apply. This reduction in cost and ease of application will have particular impact on the maintenance budgets for playing fields, particularly those playing fields used for youth sports, recreational leagues and municipal or school athletic programs.

The granulated water absorbing polyacrylate, such as potassium acrylate or sodium acrylate, may be applied directly to turf surface to create the gel-like material for removal. The polyacrylate may also be placed in water absorbent bags such as bags made from tightly woven cotton. These bags of granulated water absorbing polyacrylate can then be placed directly on the turf areas where water has accumulated. Standing water will be absorbed by the bags of polyacrylate and produce a gel which will be held and confined by the bag. After the water is absorbed and the resulting gel-like material is produced, the bags with the gel-like material confined by the bag can be readily picked up and transported for disposal.

DESCRIPTION

Figure 1:
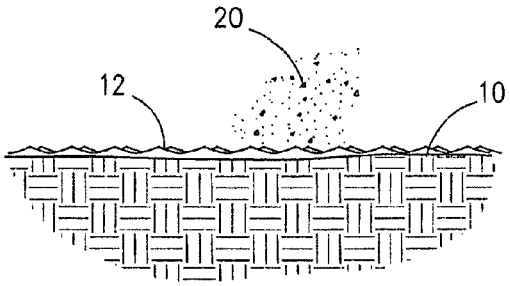
FIG. 1 through FIG. 4 show a schematic view of a method of applying a water absorbing polyacrylate as a vehicle for water collection on athletic field surfaces.

Referring to the drawings, it was found that the use of a water absorbing polyacrylate such as acrylamide/potassium acrylate copolymer, cross-linked, a whitish granular odorless copolymer, will produce efficacious results when used as a vehicle for absorbing standing rainwater on outdoor athletic playing fields. As shown in FIGS. 1-4, the method of the invention provides for spreading granular water absorbing polyacrylate over the standing rainwater. In FIG. 1, a schematic of a playing field surface (10) having standing rainwater (12), water absorbing polyacrylate polymer (20), such as acrylamide/potassium acrylate copolymer, cross-linked, is distributed over the standing rainwater (12). The polymer (20) may be sprinkled by hand over areas of a playing field surface where standing water is concentrated. The polymer (20) may also be spread over a wider area of the play field surface by use of a broadcast spreader.

Figure 2:
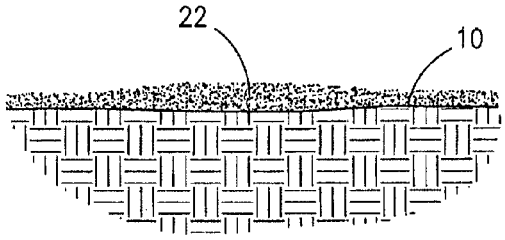

After the polymer (20) is spread over the standing rainwater (12) on a playing field surface (10), the rainwater water (12) will be absorbed from the playing surface (10), after only about five minutes, leaving a gel-like material (22) formed from the combination of the polymer (20) and rainwater (12) as shown in schematic form in FIG. 2. This gel-like material (22) may then be collected for disposal by being scooped up from the playing surface (10) by means of a shovel (26) or other means to remove the gel-like material (22) from the playing surface (10). As shown in schematic representation in FIG. 4, any remaining amounts of the gel (22) produced after the polymer (20) is applied to the rainwater may be simply raked into the field surfaces (10) by means of a rake (28). Raking the remaining gel (22) into the field surface will have only a minimal effect on the playing surface (10). It is thought that the use one pound of water absorbing polyacrylate polymer (20) will absorb at least 250 times its weight of the standing rainwater (12).

Acrylamide/potassium acrylate copolymer, cross-linked, is the preferred water absorbent polymer (20) because its potassium composition would not materially affect or damage turf grasses. Consequently, such potassium acrylate could be used on both grass and dirt surfaces to produce the gel-like end product from the accumulated rainwater. Potassium acrylate might be used on football fields, golf courses, or the infield dirt surfaces and the outfield and infield grass of baseball fields without anticipating any deleterious effects from its use.

A water absorbing polyacrylate polymer (20) such as sodium acrylate will have similar water absorbing medium properties as potassium acrylate and sodium acrylate will produce a gel-like material in combination with rainwater as an end product similar to that produced by potassium acrylate. While use of sodium acrylate may have some long term deleterious effect on the turf grasses due to its sodium (salt) based nature, or to grass areas where field drainage runoff is anticipated, sodium acrylate could still be utilized with efficacy on the grass-free field surfaces of an athletic field.

Figure 5:
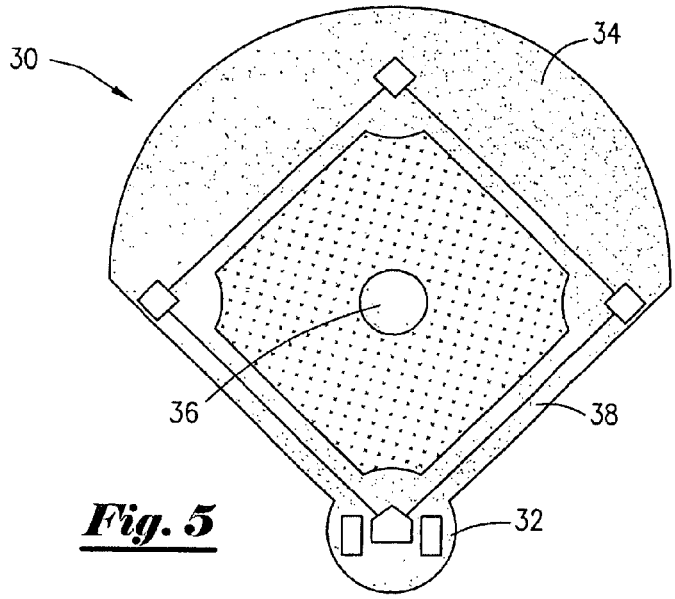
FIG. 5 is a schematic view of a baseball field showing areas of potential use of the method of FIG. 1.

In the case of the baseball infield (30), shown in schematic in FIG. 5, either potassium acrylate or sodium acrylate might be utilized as the polymer (20) to be applied to absorb rainwater on the infield dirt surfaces such as the catcher's and batters boxes (32) around home plate, the infield surfaces (34), the pitcher's mound (36), and the base paths (38). Because of the ability of potassium acrylate or sodium acrylate as the polymer (20) to absorb many times their weight in water, only a relative minimal amount of the polymer (20) material is needed to prepare a playing surface, such as baseball field, for play after a heavy rain downpour.

Figure 4:
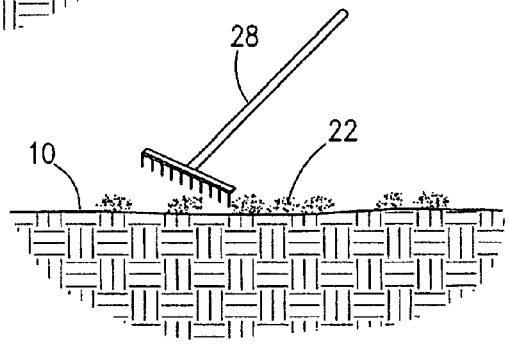

When the infield surface (30) has been completely saturated and play has been suspended, it is suggested that twenty pounds of the polymer (20) material be spread evenly over the entire infield including the catcher's and batter's boxes (32) around home plate, the infield surfaces (34), the pitcher's mound (36), and the base paths (38). After waiting about five minutes the gel-like material (22) will be formed by the combination of the polymer (20) with the rainwater. The gel-like material (22) can then be raked into the dirt surfaces of the infield (30) as illustrated in FIG. 4 and the field will be ready for resumed play.

If the infield (30) is not completely saturated with rainwater, especially areas around the pitcher's mound (36), the polymer (20) may be applied as needed, allowed time to absorb the rainwater, and then raked into the dirt surface until the playing surface is ready for play. It is thought that one pound of polymer (20) such as potassium acrylate or sodium acrylate will absorb up to 30 gallons of standing water.

Figure 3:
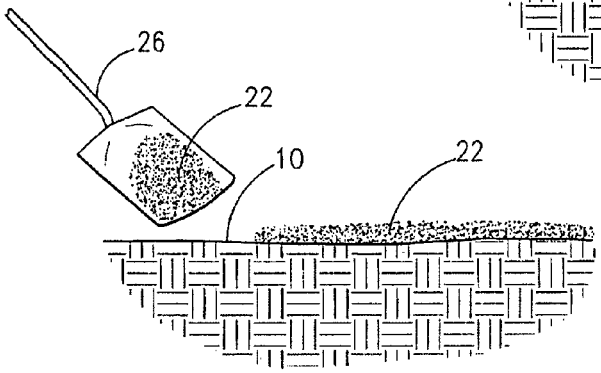

In areas of standing water, the gel-like material (22) produced from the polymer (20) may accumulate into a thick mass. In such situations, the gel-like material (22) may be removed with a shovel as illustrated in FIG. 3 for disposal. Attempting to rake a thick mass of the gel-like material (22) may slow the drying process.

Figure 6:
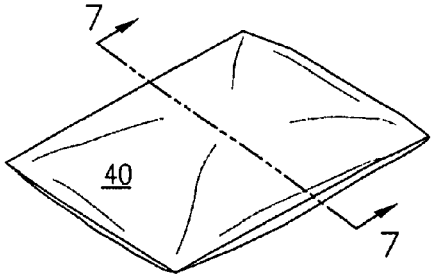
FIG. 6 is a schematic view of an applicator bag and water absorbing polyacrylate combination of Applicant's invention.
Figure 7:
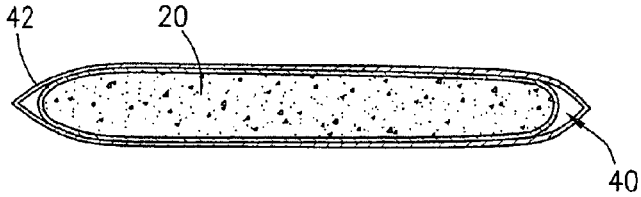
FIG. 7 is a schematic cross-section view of a bag of FIG. 6.
Figure 8:
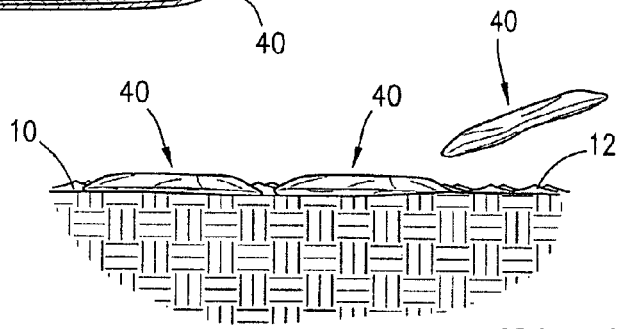
FIG. 8 is a schematic view of a method of use of the applicator bag and water absorbing polyacrylate combination of FIG. 6 as a vehicle for water collection on athletic field surfaces.
Figure 9:
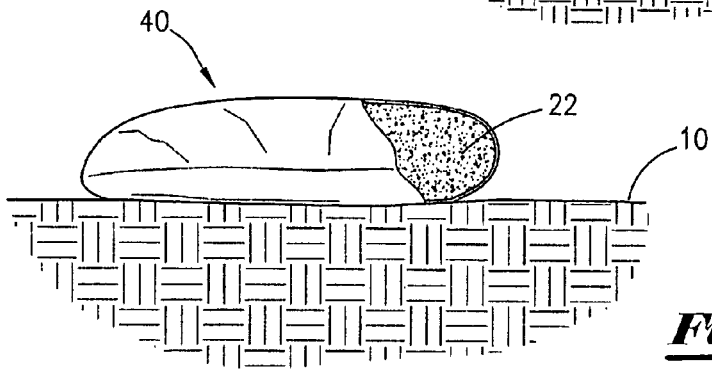
FIG. 9 is a schematic view of the bag and water absorbing polyacrylate combination after application to standing rainwater on an athletic field playing surface.

As shown in schematic representation in FIG. 6 and FIG. 7, the granulated water absorbing polyacrylate polymer (20) whether potassium or sodium based, may also be placed in a water absorbent bag (40) such as a bag made from tightly woven cotton. A plurality of bags (40) containing the polymer (20), such as potassium acrylate or sodium acrylate, may be placed directly on a playing field surface (10) where rainwater (12) has accumulated. About five to ten minutes after application, the standing rainwater (12) will be absorbed by the bags (40) and produce the gel-like material (22) which will be held and confined by the bags (40). After the rainwater (12) is absorbed into the bag (40) and the resulting gel-like product (22) is produced, the bags (40) with the gel-like material (22) contained therein can be readily picked up and transported for disposal. The bags (40) may be made of different sizes.

The bags (40) may be provided with a removable water impermeable outer bag as a lining bag (42) to prevent unwanted moisture from entering the bag (40). The removable impermeable lining bag (42) will facilitate storage of the absorbent bags (40) containing the polymer (20). Multiple bags (40) may be placed in a lining bag (42). (20). The lining bag (42) will be removed before the bags (40) are place on a playing field It is suggested that no more than one-half ounce per gallon of bag (40) capacity of the polymer (20), such as potassium acrylate or sodium acrylate, be used. Amounts of the polymer (20), such as potassium acrylate or sodium acrylate, in excess of one-half ounce per gallon of bag (40) capacity might result in the bag (40) being torn or ripped as the gel-like material (22) is produced when the bag (40) with the polymer (20) is exposed to the rainwater.

It is expected that a bag (40) configured to hold one gallon by volume that contains approximately one-half ounce of water absorbing polyacrylate polymer (20), whether potassium acrylate or sodium acrylate, will absorb up to one gallon of rainwater and will weigh approximately eight pounds when the water is fully absorbed. Similarly, a bag (40) configured to hold fifteen gallons by volume that contains at least eight ounces of water absorbing polyacrylate polymer (20), whether potassium acrylate or sodium acrylate, will absorb up to fifteen gallons of rainwater and will weigh approximately one hundred twenty-five pounds when the water is fully absorbed.

It is thought that the method of the present invention and many of its attendant advantages will be understood from the foregoing description and it will be apparent that various changes may be made in the arrangement of the steps thereof without departing from the spirit and scope of the invention or sacrificing all of its material advantages, the methods described herein being merely exemplary embodiments of the invention.

I claim:

1. The method of remediation of an athletic field playing surface after a rainfall comprising the steps of:

a. providing a quantity of water absorbing polyacrylate polymer;

b. spreading said quantity of water absorbing polyacrylate polymer over a desired area of athletic field playing surface;

c. allowing time for said quantity of water absorbing polyacrylate polymer to absorb rainwater present on said athletic field playing surface;

d. producing a gel from said quantity of water absorbing polyacrylate polymer and said absorbed rainwater;

e. providing means for raking said gel into said playing surface; and f. raking said gel into said athletic field playing surface with said raking means.

2. The method as recited in claim 1 comprising the additional step of removing a portion of said gel from said desired area of athletic field playing surface.

3. The method as recited in claim 2 wherein said step of removing said gel from said desired area of athletic field playing surface includes removing said gel with a shovel.

4. The method as recited in claim 3 wherein said step of spreading said quantity of water absorbing polyacrylate polymer over a desired area of athletic field playing surface includes spreading said quantity of water absorbing polyacrylate polymer with a broadcast spreader.

5. The method as recited in claim 1 wherein said step of providing a quantity of water absorbing polyacrylate polymer includes providing one pound of water absorbing polyacrylate polymer for every 30 gallons of rainwater to be removed.

6. The method as recited in claim 1 wherein said step of providing a quantity of water absorbing polyacrylate polymer includes providing acrylamide/potassium acrylate copolymer.

7. The method as recited in claim 1 wherein said step of providing a quantity of water absorbing polyacrylate polymer includes providing sodium acrylate.

8. The method of remediation of an athletic field playing surface after a rainfall comprising the steps of:

a. providing a quantity of granular polyacrylate polymer;

b. spreading said quantity of granular polyacrylate polymer over a desired area of water saturated athletic field playing surface; and c. raking said quantity of granular polyacrylate polymer into said desired area of water saturated athletic field playing surface.

9. The method as recited in claim 8 wherein said step of providing a quantity of granular polyacrylate polymer includes providing granular potassium acrylate.

10. The method as recited in claim 9 wherein said step of spreading said quantity of granular potassium acrylate over a desired area of water saturated athletic field playing surface includes spreading said quantity of granular potassium acrylate with a broadcast spreader.

11. The method of remediation of an athletic field playing surface after a rainfall comprising the steps of:

a. providing a quantity of water absorbing potassium acrylate;

b. spreading said quantity of water absorbing potassium acrylate over a desired area of standing rainwater on an athletic field playing surface;

c. allowing time for said quantity of water absorbing potassium acrylate to absorb said standing rainwater and thereby producing a gel; and d. raking said gel of said absorbed rainwater into said athletic field playing surface and thereby minimizing the effect of said gel on said athletic field playing surface.

12. The method as recited in claim 11 wherein said step of spreading said potassium acrylate over a desired area of standing rainwater on an athletic field playing surface includes spreading said potassium acrylate with a broadcast spreader.

13. The method as recited in claim 12 wherein said step of raking said gel into said athletic field playing surface includes raking said gel into said athletic field playing surface with hand tools.

* * * * *